United States Patent [19]

Thompson

[11] 4,116,446

[45] Sep. 26, 1978

[54] GAME NET SUPPORT APPARATUS

[75] Inventor: Roger E. Thompson, Adelaide, Australia

[73] Assignee: R.E.T. Nominees Pty. Ltd., Adelaide, Australia

[21] Appl. No.: 738,448

[22] Filed: Nov. 3, 1976

[51] Int. Cl.[2] ..... A63B 67/00

[52] U.S. Cl. ..... 273/181 F; 273/127 B

[58] Field of Search ..... 273/26 A, 35 R, 181 F, 273/181 A, 181 R, 1.5 R, 1.5 A, 55 B, 29, 127 R, 127 B, 95 H, 95 R, 177 R, 102 S, 105 R, 105 A, 1 B, 85 R, 96 R, 105; 272/100; 135/1 R, 3 E, 3 R, 4 R, 5 R; 140/82, 79, 80, 90, 92.2; D88/1

[56] References Cited

U.S. PATENT DOCUMENTS

| | | | |
|---|---|---|---|
| 1,058,142 | 4/1913 | Bernitt | 135/1 R |
| 3,312,467 | 4/1967 | Dawson | 273/26 A |
| 3,434,483 | 3/1969 | Topham | 135/5 R |
| 3,929,334 | 12/1975 | Magazzu | 273/26 A |

FOREIGN PATENT DOCUMENTS

| | | | |
|---|---|---|---|
| 1,910,844 | 9/1970 | Fed. Rep. of Germany | 273/127 B |
| 934,599 | 8/1963 | United Kingdom | 273/181 F |

*Primary Examiner*—Richard C. Pinkham
*Assistant Examiner*—T. Brown
*Attorney, Agent, or Firm*—Oldham, Oldham, Hudak & Weber Co.

[57] ABSTRACT

Apparatus for supporting different nets for various sporting purposes including interengaging tubular rods which are arranged to interconnect and have ground engaging portions suitable to be useful for the several functions. The frame of the net support structure includes a pair of spaced apart, vertically extending posts; each of the posts is divided into a pair of telescoping sections. An upper horizontally extending multi-section member extends and connects the upper end of the vertical posts. A U-shaped clip is provided to engage the frame support with resilient holding pressure for supporting a net on the frame.

1 Claim, 6 Drawing Figures

GAME NET SUPPORT APPARATUS

Figure 1:
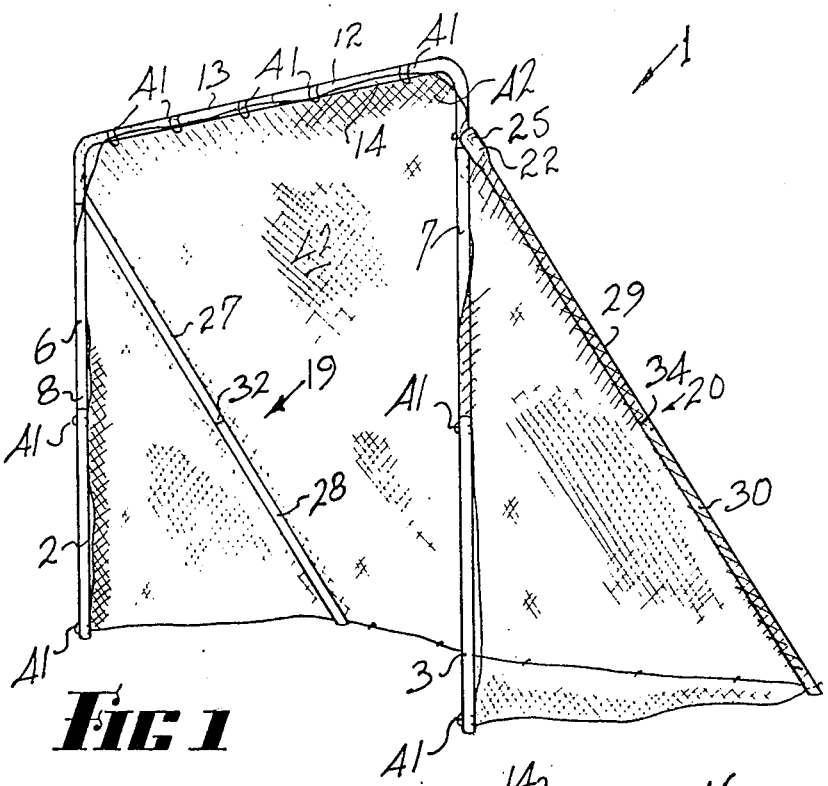

This invention relates to sporting equipment. Many sports to be played effectively require a net.

The net in each case however is somewhat different in size and support height and often in shape and a separate net and support structure is required for the playing of various sports.

For instance a goal net for soccer is of a completely different shape and arrangement than a net for volley ball or again a net for tennis.

Similarly if a practice net is required for golf or for tennis or any other similar game, this also is differently shaped and requires separate purchase by the player.

The same applies whether the game is being played with full size nets or whether the nets are of reduced size for play in restricted areas more for recreation than a serious playing of the sport.

Nonetheless in each case there is a variety of nets and supports required and it is to this problem that this invention is directed.

I have observed that a soccer goal net support frame which is perhaps the most complex support frame that would be required might be able to be made in such a way that it could also be used for playing of other games including supporting of a net for volley ball that is a high net or tennis that is a low net and it also could be used to act as a practice net into which tennis balls or golf balls may be driven for practising playing strokes.

The invention can be said to reside in apparatus to support a net for sporting purposes the apparatus including a first two tubular rods, each having one end thereof tapered so as to be adapted to be engageable within the ground and be supported vertically by such ground engagement, a second two tubular rods, each having a lower end adapted to engage and be supported vertically by an upperend of one of the first two rods, a cross-bar constituted by at least two tubular separable rods, the cross-bar including downwardly depending end portions adapted to be removably engageable with, in each case, the upper end of the said second two tubular rods, and two rearwardly extending downwardly inclined stabilizing legs, each stabilizing leg detachably securable at an upper end to one of the vertically aligned portions of the rods, and, at a lower end, in each case, adapted to be at least ground engaging, each stabilizing leg being characterized by including at least two end to end separably engaging tubular rods, the arrangement being further characterized in that at least one of the stabilizing rods from each leg is adapted to detachable engage in end to end relationship at least one of the vertical rods, and net engaging means located in spaced apart positions along at least some of the said tubular rods and adapted to retain a net with respect to said rods.

A further aspect of the invention includes the feature that each of the two rearwardly extending downwardly inclined stabilizing legs is adapted to be attached to one of the rods adapted to be positioned in the vertical position by means of a screw threaded bolt and a nut and the bolt passing through mutually positioned apertures one in the rod adapted to be aligned in the vertical position and the other in the end thereof of the stablizing leg.

A further feature of this invention can reside in the net engaging means these being prosecuted by a resilient clip adapted to resiliently engage around the circumference of any one of the said tubular rods.

Such features as the above and others will be better appreciated by reference to an accompanying description of a preferred embodiment and also claims attached with the specification.

Figure 2:
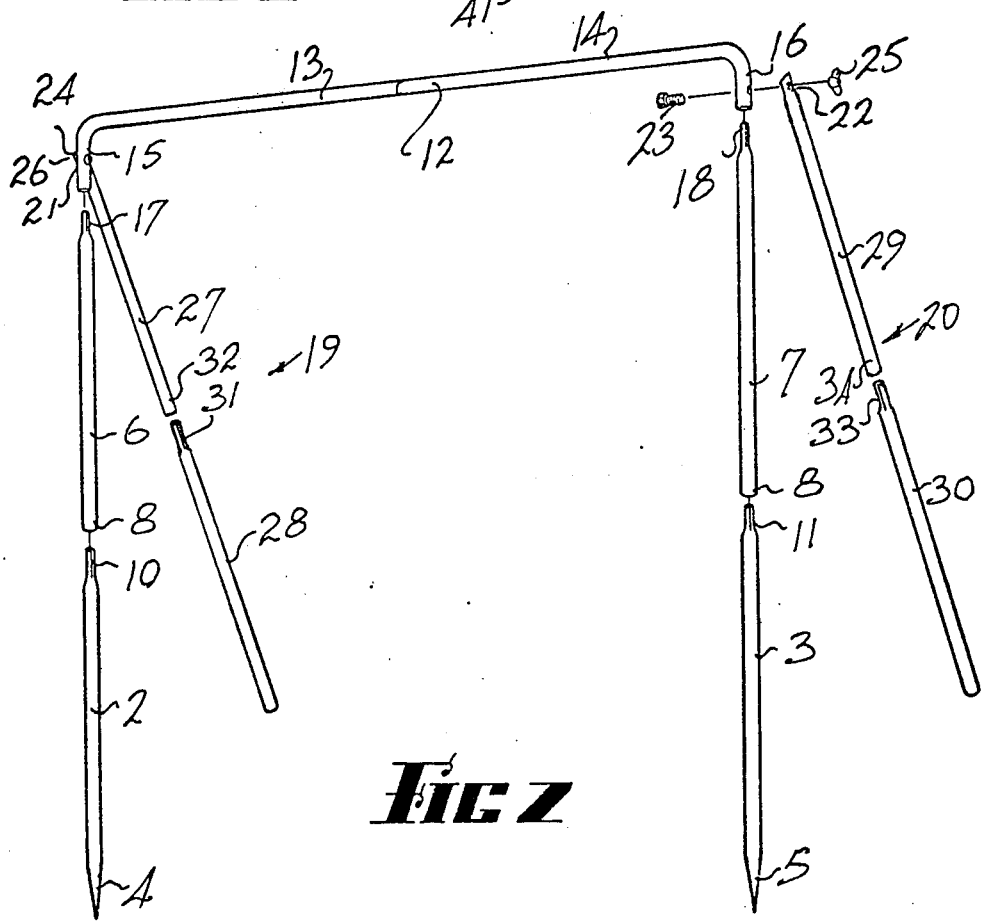
Figure 3:
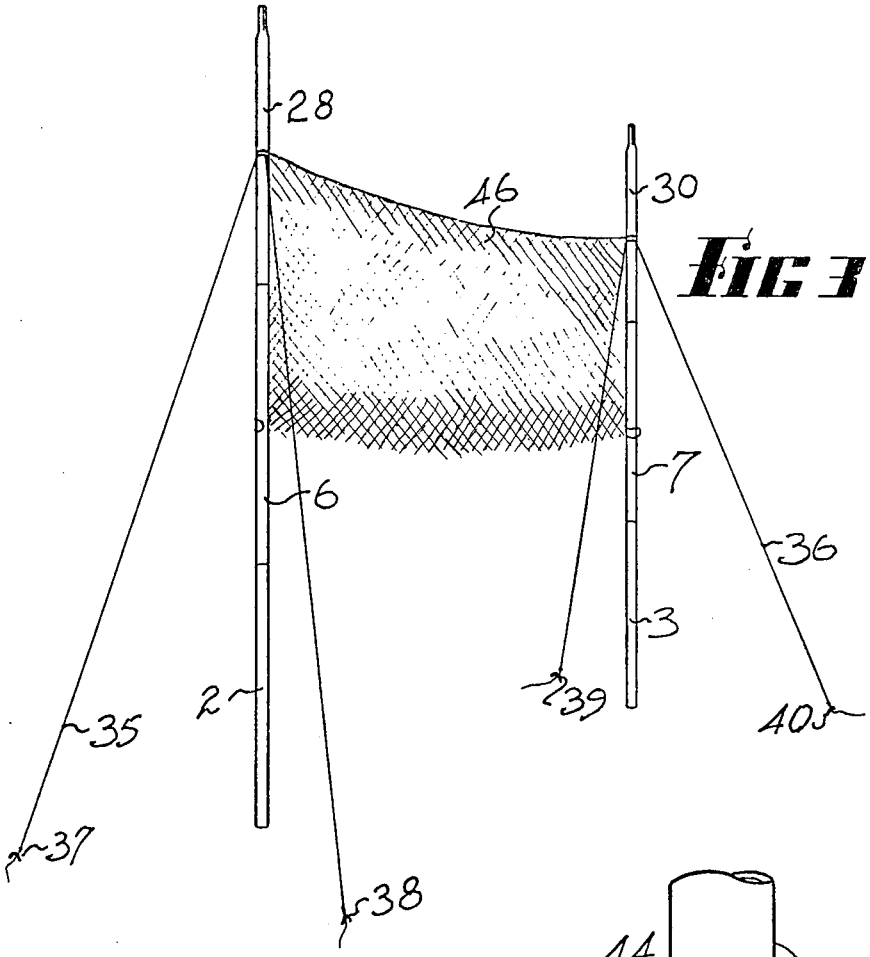
Figure 4:
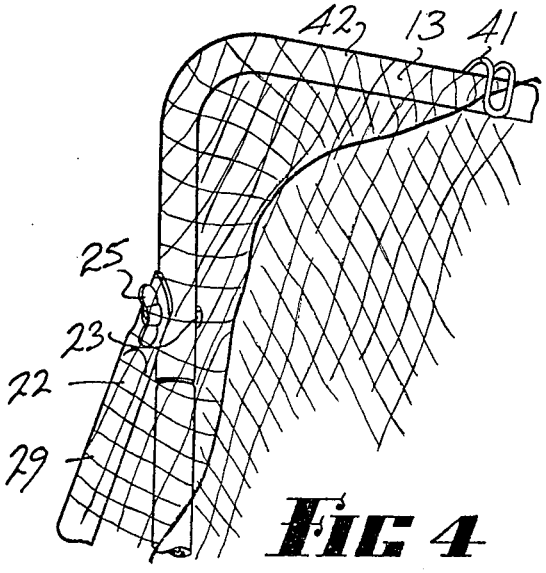
Figure 5:
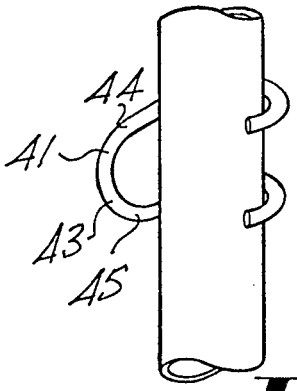
Figure 6:
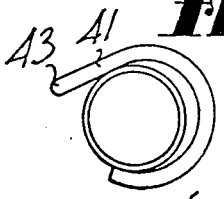

Referring then to the preferred embodiment with the assistance of drawings,

FIG. 1 shows an assembled apparatus together with a net arranged so that is can act as a soccer goal net, the view showing the assembled apparatus as it would appear when in an erect position with portions of the tubular rod penetrating the ground, FIG. 2 is the same embodiment as in FIG. 1 except that the frame only in this case is shown as an exploded view, FIG. 3 is a perspective view indicating a second application for the apparatus, FIG. 4 shows in closer detail a portion of the apparatus when assembled as in FIG. 1, FIG. 5 shows in closer detail one of the resilient clips as in position around one of the tubular rods and FIG. 6 shows the same arrangement as in FIG. 5 the view however being from above the rod in this case.

Referring in detail to the drawings, this shows the apparatus 1 referring in particular to FIGS. 1 and 2 in which there are a first two tubular rods 2 and 3 each of which have an end 4 and 5 tapered so as to be adapted to be engageable within the ground as is shown in the position these are in FIG. 1.

It will be observed each of the rods 2 and 3 are supported in a vertically orientated position by such ground engagement.

A second two tubular rods 6 and 7 each have a lower end 8 and 9 adapted by region of being an open socket, to engage in the supported vertically by an upper end 10 and 11 of the rods 2 and 3 by reason that the ends 10 and 11 are slightly collapsed over a modest length the outer diameter of the collapsed portion closely matching the inner diameter of the ends 8 and 9.

A cross-bar 12 is constituted by two separated tubular separable rods 8 and 9.

A cross-bar 12 is consituted by two separate tubular separable rods 13 and 14 each of these rods 13 and 14 including a downwardly depending portion 15 and 16 such portions 15 and 16 beihg adapted by being an open tubular member to removably engage with, in each case, the upper end 17 and 18 of the rods 6 and 7. The upper ends 17 and 18 are, in each case, again as in the case of rods 2 and 3 compressed or swaged so their external diameter matches the internal diameter of the portions 15 and 16 so that there is a close fit to provide a tongue socket engagement.

The tubular rods 13 and 14 are engaged likewise by a removable socket portion on one of the rods engaging a tongue portion of the lesser diameter on the other.

There are two rearwardly extending downwardly inclined stabilizing legs 19 and 20 in each case the legs 19 and 20 having an upper end 21 and 22 compressed and drilled and there is in each case two threaded bolts 23 and 24 passing through matching fixtures in the portions 15 and 16 and in the end 21 and 22 and the bolts 23 and 24 held by a wind nut 25 and 26.

Each of these stabilizing legs 19 and 20 are constituted by comprising two end to end separably engaging tubular rods 27, 28, 29 and 30 the separable engagement being by reason again an upper end 31 engaging by reason of lesser diameter within the socket formation of the lower end 32 or again the upper end 33 into the socket formation 34.

In each case the material used for the frame is a modest gauge net or material and each tube is of circular cross-section.

The apparatus is universally applicable to support nets of many types and as indicated of another applicaton, as shown in FIG. 3 the rods 2 and 3 have in their ground engaging portion positioned in the ground so to be vertically supported and this in turn supports the rods 6 and 7 which in turn supports the rods 28 and 30 which were formerly a lower end of each of the stabilizing rods 19 and 20.

In the case as shown in FIG. 3 it may be considered desirable to have stabilizing cords and these are shown 35 and 36 which are wrapped around an upper portion of each of the rods 28 and 30.

The cords in each case are secured by retaining pins 37, 38, 39 and 40.

The nets in each case must be secured in an economic manner to the rods and this is achieved in this embodiment by use of a resilient clip this application being shown where the clips 41 are positioned at base locating along each of the rods as is considered appropriate by the particular application.

For instance if the apparatus is to be used as a soccer goal net, a larger number of clips might be used than if another application might be considered which might not subject a net to a substantial pressure.

The location of the clips as will be seen from the respective drawings, can be selected and varied according to any desired layout.

In FIG. 4 the clip 41 is shown partially engaged over the rod 13 and has snared the net 42 by the resilient pressure.

The clip in this embodiment is constituted by a bent wire member the shape as will be surmised from the drawings particularly in FIG. 4, FIG. 5 and FIG. 6, including a first U-portion 43 and each leg of the U-portion 44 and 45 terminating in a further U-shape the common plane of which is transversed the common plane of the first few sections 43.

The net in the case of FIG. 3 is shown as 46 and is of course a different net of that as shown in FIG. 1 or a section of which is shown in FIG. 4.

This then describes the preferred embodiment from which however will mean that the proprosal provides an arrangement which can used for a large number of arrangements by which nets can be supported for sporting purposes and the means proposing such variety of net supporting purposes can be manufactured economically, are readily assembled and could be expected to be of relatively long lasting character.

It is a feature, that it becomes economic where such universality is a characteristic of the arrangement to provide units of this type for a much wider market because of the effective lower cost per application that is now possible and has otherwise been the case.

I claim:

1. Apparatus to support a net for sporting purposes including a first two tubular rods, each having one end thereof tapered so as to be adapted to be engageable within the ground and supported vertically by such grounding engagement, a second two tubular rods; each having a lower end adapted to engage and be supported vertically by an upper end of one of the first two rods, a cross-bar constituted by at least two tubular separable rods, said cross-bar including downwardly depending end portions adapted to be removably engageable with, in each case, the upper end of the said second tubular rods, and two rearwardly extending downwardly inclined stabilizing legs, each stabilizing leg being removably securable at an upper end to one of the vertically aligned portions of the rod, and, at a lower end, in each case, adapted to be at least ground engaging, each stabilizing leg being characterized by including at least two end to end separably engaging tubular rods, the arrangement being characterized in that at least one of the stabilizing rods from each leg is adapted to detachably engage in entering relationship at least one of the vertical rods, and net engaging means located in spaced apart positions along at least some of the said tubular rods, and adapted to retain a net with respect to the rods; and said net engaging means being characterized by including a resilient U-shaped clip adapted to engage around any of said rods with resilient holding pressure and support a net thereby.

* * * * *